US006742366B1

(12) United States Patent
Lai

(10) Patent No.: US 6,742,366 B1
(45) Date of Patent: Jun. 1, 2004

(54) LOCKING AND SECURING SYSTEM FOR SLOT BEARING PRODUCTS

(75) Inventor: Eric Lai, Sheung Shui (HK)

(73) Assignee: The Sun Lock Company Ltd. (HK)

( * ) Notice: Subject to any disclaimer, the term of this patent is extended or adjusted under 35 U.S.C. 154(b) by 0 days.

(21) Appl. No.: 10/328,238

(22) Filed: Dec. 23, 2002

(51) Int. Cl.[7] ..... E05B 69/00; E05B 73/00
(52) U.S. Cl. ..... 70/58; 70/30; 70/49; 70/63
(58) Field of Search ..... 70/58, 30, 49, 70/63, 423–428; 248/551–553

(56) References Cited

U.S. PATENT DOCUMENTS

| | | | | | |
|---|---|---|---|---|---|
| 2,992,551 | A | * | 7/1961 | Campbell | 70/58 |
| 3,091,011 | A | * | 5/1963 | Cleveland | 280/814 |
| 3,277,676 | A | * | 10/1966 | Poehlmann et al. | 70/58 |
| 4,047,686 | A | * | 9/1977 | Porter | 248/552 |
| 4,733,840 | A | | 3/1988 | D'Amore | 248/200.3 |
| 4,856,304 | A | * | 8/1989 | Derman | 70/14 |
| 4,907,111 | A | * | 3/1990 | Derman | 360/97.02 |
| 5,327,752 | A | | 7/1994 | Myers et al. | 70/58 |
| 5,361,610 | A | * | 11/1994 | Sanders | 70/14 |
| 5,381,685 | A | | 1/1995 | Carl et al. | |
| 5,400,622 | A | * | 3/1995 | Harmon | 70/14 |
| 5,579,657 | A | | 12/1996 | Makous | |
| 5,608,605 | A | * | 3/1997 | Siow et al. | 361/684 |
| 5,632,165 | A | | 5/1997 | Perry | |
| 5,722,268 | A | * | 3/1998 | Choi | 70/58 |
| 5,787,739 | A | * | 8/1998 | Derman | 70/58 |
| 5,907,962 | A | | 6/1999 | Smithson et al. | |
| 5,913,907 | A | * | 6/1999 | Lee | 70/58 |
| 6,000,252 | A | * | 12/1999 | Murray et al. | 70/58 |
| 6,006,557 | A | * | 12/1999 | Carl et al. | 70/58 |
| 6,038,891 | A | | 3/2000 | Zeren et al. | |
| 6,094,949 | A | * | 8/2000 | Lagerberg et al. | 70/14 |
| 6,112,561 | A | | 9/2000 | Carl | |
| 6,178,089 | B1 | * | 1/2001 | Alfonso et al. | 361/727 |
| 6,182,481 | B1 | | 2/2001 | Nagy | |
| D439,824 | S | * | 4/2001 | Lai | D8/334 |
| D439,825 | S | * | 4/2001 | Lai | D8/334 |
| 6,227,016 | B1 | * | 5/2001 | Yu | 70/30 |
| 6,301,940 | B1 | | 10/2001 | Derman et al. | |
| 6,305,197 | B1 | | 10/2001 | Ling | 70/18 |
| 6,308,928 | B1 | | 10/2001 | Galant | 248/5.53 |
| 6,341,510 | B1 | | 1/2002 | Tervo et al. | 70/58 |
| 6,389,854 | B1 | | 5/2002 | Huang | 70/58 |
| 6,418,759 | B1 | * | 7/2002 | Zeren et al. | 70/58 |
| 6,474,116 | B1 | * | 11/2002 | Lai | 70/25 |
| 6,619,081 | B1 | * | 9/2003 | Yu | 70/58 |
| 6,672,117 | B2 | * | 1/2004 | Yu | 70/58 |
| 2003/0029208 | A1 | * | 2/2003 | Merrem et al. | 70/58 |
| 2003/0106349 | A1 | * | 6/2003 | Broadbridge et al. | 70/58 |

* cited by examiner

*Primary Examiner*—John B. Walsh
(74) *Attorney, Agent, or Firm*—Melvin I. Stoltz

(57) ABSTRACT

By providing a uniquely constructed, dual plate, computer engaging and locking member which is quickly and easily inserted into the receiving slot typically formed in a computer, such as a laptop computer, or other valuable product, in combination with an integrated, elongated cable member and padlock, a highly effective computer lock system is attained. One principal component of the locking system of the present invention is the uniquely constructed dual plate, computer engaging member which is easily inserted into a receiving slot when in a first position and securely retained therein when in its second position. In addition, a uniquely constructed combination padlock having a dual locking system is also employed.

18 Claims, 5 Drawing Sheets

LOCKING AND SECURING SYSTEM FOR SLOT BEARING PRODUCTS

TECHNICAL FIELD

This invention relates to locking systems and, more particularly, to fully integrated locking systems constructed for securely locking and affixing computers in a particular location.

BACKGROUND ART

Numerous locking constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular due to ease and convenience of use is a combination lock which employs a plurality of rotatable independent dials, each of which forms one of indicia, usually numerals or letters, comprising a combination for releasing a J-shaped shackle which is integrally formed as a component of the lock. However, due to the typical dimensions employed for the lock body and the integrated shackle, only a limited area or small components can be secured, and the lock is incapable of being employed for products which are not able to fit within the dimensional limitations of the shackle. Consequently, this popular lock construction is generally incapable of being used in the field of securing computers, or other valuable products.

One area which has received substantial prior art attention is the ever-increasing need for securely locking and affixing computer equipment to a particular location. Although this need is widespread throughout many different industries, the need is most acute in schools and colleges, where unwanted removal of computers often occurs. Although it has been found that all computer equipment has been subjected to such unwanted pilfering, the problem is most severe with laptop computers, due to their inherent highly portable nature.

As a result, substantial effort has been expended in attempting to create a securement system for computers, particularly laptop computers. In this regard, many computers, particularly laptops, incorporate a slot formed in the body thereof which can be employed with a cooperating locking key or adapter. However, in spite of the substantial effort that has been expended in creating a wide variety of slot engaging adapters, as well as associated locking hardware, these prior art systems have failed to provide a universally applicable, easily used, secure and dependable, fully integrated computer locking system which is capable of satisfying all of the consumer requirements and demands.

Therefore, it is a principal object of the present invention to provide an integrated computer locking system which is easily employed and securely affixes and lockingly retains any desired computer or similar product in any desired location.

Another object to the present invention is to provide an integrated computer locking system having the characteristic features described above which virtually eliminates the ability of unauthorized persons from gaining access to the lock by attempting to pick the lock using known techniques.

Another object of the present invention is to provide an integrated computer locking system having the characteristic features described above which incorporates an easily used, readily engageable locking plate assembly which is constructed for being lockingly secured and retained in the receiving slot of a computer and cooperatingly associated with a cable and combination lock to provide the desired computer securement.

Another object to the present invention is to provide an integrated computer locking system having the characteristic features described above which employs a combination lock construction as a component of this system which provides two separate and independent locking members integrally formed therein, for enabling virtually all types of products and locations to be quickly and easily employed as anchors or securement devices.

Another object in the present invention is to provide an integrated computer locking system having the characteristic features described above wherein the two separate and independent locking members operate using the same combination lock assembly, thereby providing flexibility as well as ease of construction and assembly.

Another object of the present invention is to provide an integrated computer locking system having the characteristic features described above wherein the combination lock component employs visual indicators which are prominently displayed in an easily seen and readily recognized manner.

Other and more specific object will in part the obvious and will in part appear hereinafter.

SUMMARY OF THE INVENTION

By employing the present invention, all of the difficulties and drawbacks of prior art lock assemblies have been overcome, and an easily employed and highly effective computer lock system is attained. In the present invention, a uniquely constructed padlock is employed which incorporates an integrated, elongated cable member which is simultaneously securely locked in a closed position with a conventional shackle member. In addition, this present invention incorporates a dual plate, computer engaging and locking member which is able to be quickly and easily inserted into the receiving slot typically formed in a computer, such as a laptop computer, or other valuable product. In this way, the securely mounted and locked engagement of any desired computer or other product is easily attained.

One principal component of the present invention is the use of a uniquely constructed combination padlock having a dual locking system. In this padlock, the housing incorporates a conventional shackle constructed for locked engagement in the housing, while also incorporating an elongated cable member which is securely locked to the housing simultaneously with the shackle. In this way, the single padlock is capable of simultaneously locking two separate and distinct areas or components. The preferred construction of this unique combination padlock is best described in detail in U.S. Pat. No. 6,474,116.

The second principal component of the locking system of the present invention is the uniquely constructed dual plate, computer engaging member. In the preferred construction of computer engaging member, a first plate component is axially moveable between two alternate positions within a second plate component which peripherally surrounds, at least partially, and securely holds the first plate component.

In addition, the first plate component comprises a uniquely constructed distal end which is dimensioned for being insertable into the receiving slot of a computer. In the preferred embodiment, the distal end of the first plate component is dimensionally enlarged both in width and thickness compared to its adjacent, intermediate bridging or interconnecting portion. Furthermore, the terminating end portion of the first plate member comprises overall dimensions which enable the end portion to be inserted into the computer slot only when the first plate component is disengaged or extended from the second plate component.

In the preferred embodiment, the dual plate computer engaging member is constructed with the first plate component slidable captured within the second plate component for movement between a first fully engaged position and a second disengaged position, When the first plate component is disengaged from the second plate component, the distal end of the first plate component is insertable into the slot formed in the computer. Preferably, the dimensions employed for constructing the distal end of the first plate component are close but less that the dimensions of the slot. As a result, insertion ease is achieved.

When the first plate component is moved into its engaged position, the distal end portion of the second plate component is aligned with and overlies the distal end of the first plate component. As a result, the overall thickness of dual plate computer engaging member is increased, causing the distal end of the first plate component to be lockingly engaged within the slot, and incapable of being withdrawn.

In order to maintain a dual plate computer engaging member securely affixed and lockingly interconnected to the computer, when in the engaged position, apertures are formed in the proximal ends of first and second plate components. By constructing these apertures to be co-axially aligned with each other when in the engaged position and enabling the cable member to pass through the apertures of these plates, movement of the first plate component relative to the second plate component is prevented. As a result, the dual plate member is retained in its securely locked and fully engaged position with the computer.

By securing the padlock and/or the cable member to a desired fixed location, the desired secure retention of a laptop computer in a precisely desired location is realized. As a result, the present invention provides the precisely desired computer securement with ease, efficiency and dependability.

The invention accordingly comprises the features of construction, combination of elements and arrangement of parts which will be exemplified in the constructions hereinafter set forth, and the scope of the invention will be indicated in the claims.

THE DRAWINGS

For a fuller understanding of the nature and objects of the invention, reference should be had to the following detailed description, taken in connection with the accompanying drawings, in which.

DETAILED DISCLOSURE

By referring to FIGS. 1–8, along with the following detailed discussion, the construction and operation of the preferred embodiment of fully integrated computer locking system 20 of the present invention can best be understood. In this disclosure, the preferred construction is fully detailed. However, alternate constructions or variations can be made without departing from the scope of this invention. Consequently it is to be understood that this disclosure is for exemplary purposes only and is not intended as a limitation of the present invention.

Figure 1:
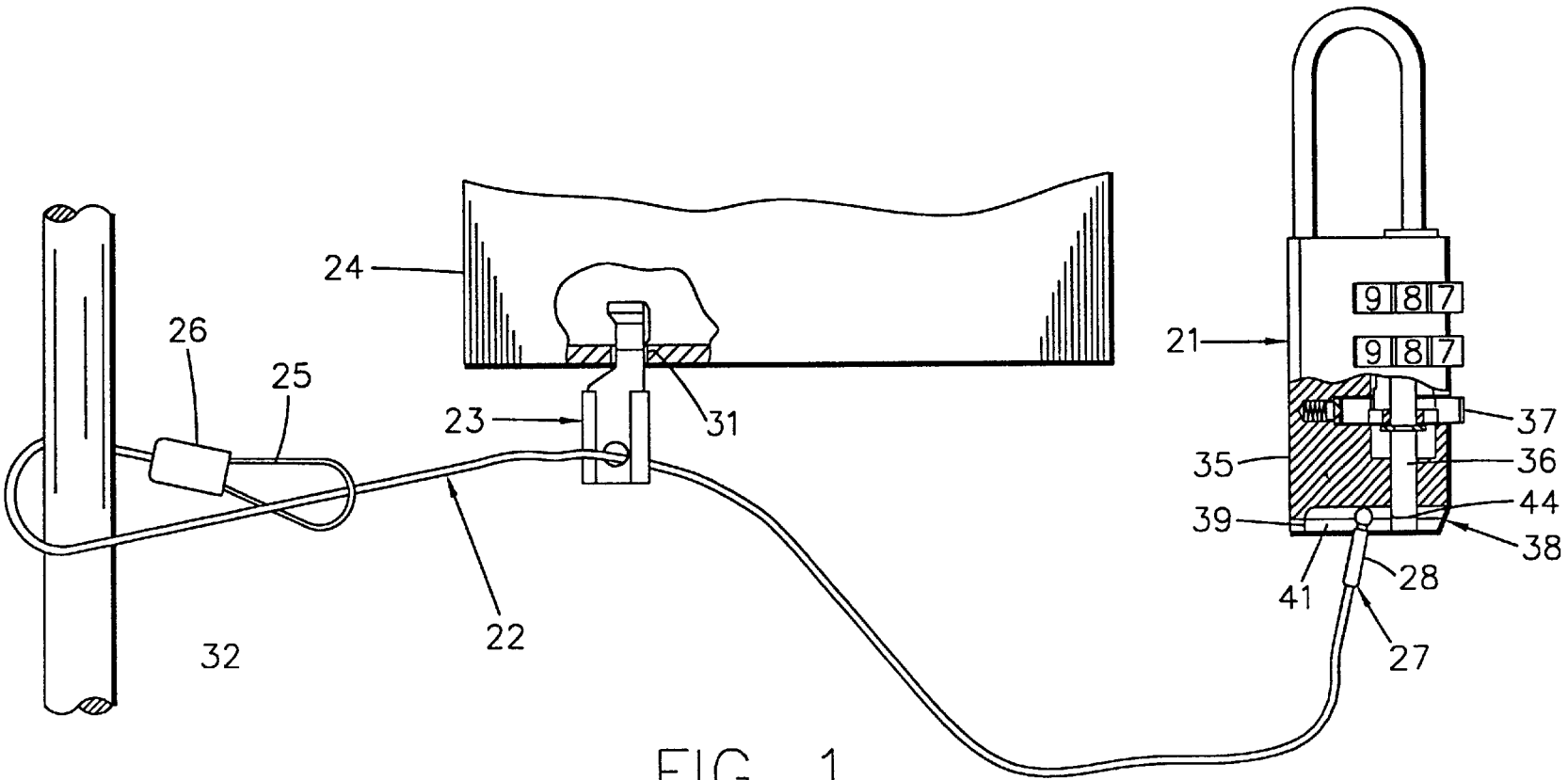
FIGS. 1 and 2 are diagrammatic views depicting the fully integrated computer locking and securing system of the present invention in alternate, fully installed arrangements with a laptop computer secured thereby.
Figure 2:
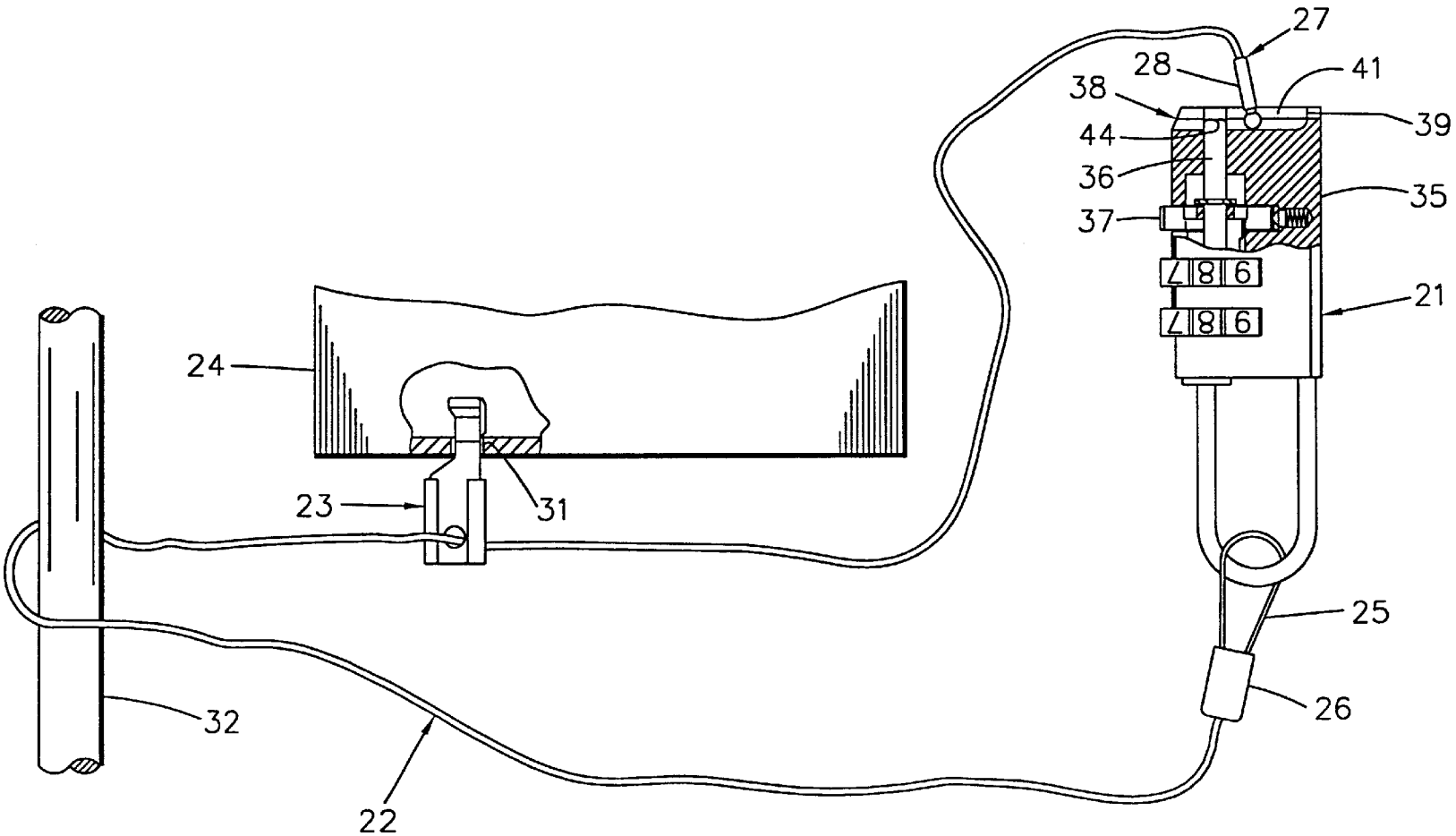
Figure 4:
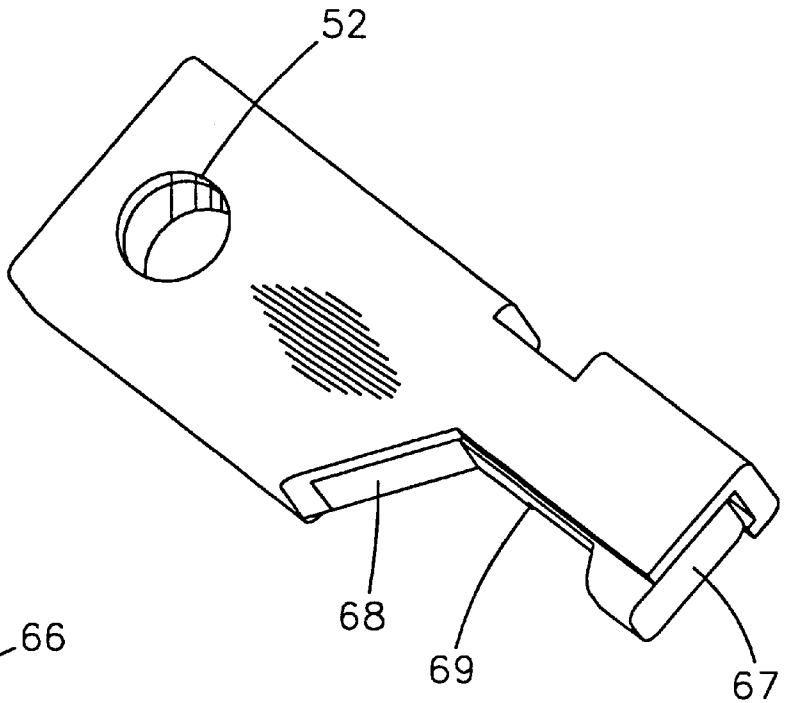
FIG. 4 is a bottom perspective view depicting the dual plate computer securing member of FIG. 3 in its closed engaging position.
Figure 3:
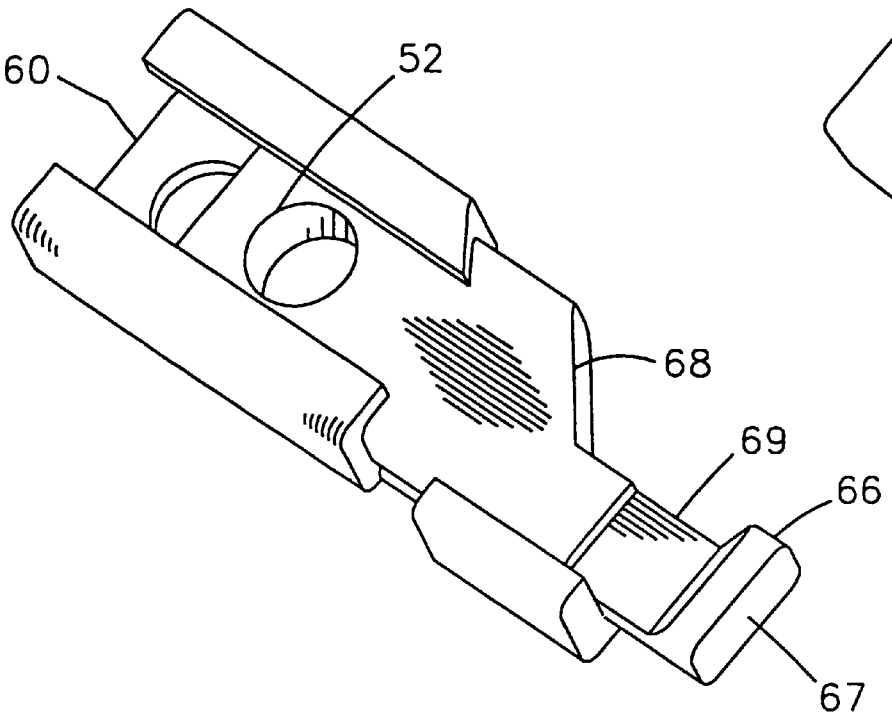
FIG. 3 is a top perspective view depicting the dual plate computer securing member of the integrated computer locking system of the present invention in its open or fully extended position.

As shown in FIGS. 1 and 2, two alternate securement arrangements are depicted employing fully integrated computer locking system 20 of the present invention. In each of these depictions, laptop computer 24 is shown. However, any computer system or other easily taken product can be secured with equal efficacy.

As depicted, computer locking system 20 comprises combination lock or padlock 21, cable member 22 and dual plate computer securing member 23. In the preferred construction, cable member 22 comprises an elongated continuous length of non-breakable, tamper-resistant material, such as heavy duty wire or metal braided fibers or filaments which are resistant to being easily cut or severed with normal cutting elements.

Furthermore, one end of cable member 22 incorporates a metal reinforced loop-defined plate 25 in combination with securement collar 26. In this way, cable member 21 incorporates an easily employed loop at one end thereof which is constructed for resisting any attempt to break or sever the loop for attaining access to computer 24, or other product, secured by system 20.

The opposed second end of cable member 22 preferably comprises end cap 27 which is securely affixed to cable member 22 in a manner which prevents its removal therefrom. In this regard, any desired affixation method can be employed, such as swaging, adhesive bonding, sonic welding, and the like. Regardless of the method employed, end cap 27 is independently secured to cable member 22 in a manner which prevents its removal or separation therefrom.

Furthermore, in the preferred construction, end cap 27 is constructed with cylindrical body portion 28, which is fixedly mounted to one end of cable member 22, rod or finger portion 29, which co-axially extends from the terminating end of portion 28 with a diameter less than the diameter of body portion 28, and enlarged, spherically-shaped end portion 30 mounted to the opposed end of rod/finger portion 29. Preferably, spherical end portion 29 comprises a diameter substantially equal to the diameter of cylindrical body portion 28.

As discussed above, U.S. Pat. No. 6,474,116 discloses a combination lock assembly and cable member which is similar to the construction of the preferred components in the present invention. As a result, and to the extent of this similarity, the disclosure of these elements in U.S. Pat. No.

6,474,116 is hereby incorporated by reference. In addition, other cable member 22 of the present invention comprises a single end cap 27. Locking system 20 can be constructed with cable member 22 having end caps at both ends thereof, as disclosed in U.S. Pat. No. 6,474,116.

In the preferred embodiment of the present invention, combination lock 21 comprises a construction which is similar to the construction shown in FIGS. 19–21 and described in the related disclosure of U.S. Pat. No. 6,474,116. Although this disclosure is incorporated by reference, a summary of the construction of combination lock 21 is hereby provided. In ths regard, combination lock 21 comprises housing 35, shackle 36 and, and rotatable dials 37 which are employed for locking and releasing shackle 36 from engagement with housing 35.

In addition, housing 35 incorporates an elongated, T-shaped or key-hole shaped holding zone 38 formed in the base of housing 35. In the preferred construction, holding zone 38 is opened along one side edge of housing 35, extending therefrom along the base of housing 35 and terminating directly adjacent the second side edge with an abutment wall 39. In addition, in the preferred embodiment, holding zone 38 comprises an enlarged channel 40 and a narrow slot 41 which extends downwardly from channel 40 to the bottom surface of housing 35, forming an elongated opened, narrow slot therein. Finally, shackle 36, and the elongated shaft within which shackle 36 is retained, extends through T-shaped holding zone 38 to the bottom surface of housing 35.

As detailed above, one end, or both ends, if desired, of cable member 22 is mounted to housing 35 for secure, locked engagement therewith. In this regard, one end, as shown in FIGS. 1 and 2 comprise the construction detailed above for endcap 27. However, if desired, both ends of cable member 22 may be constructed with endcaps 27.

In addition, enlarged channel 40 is constructed with an overall width greater than the diameter of the terminating end portion 30, while narrow slot 41 comprises a width greater than the diameter of rod portion 29 but smaller than the diameter of the terminating end portion 30. As a result, endcap 27 is incapable of being vertically removed from holding zone 38, due to the inability of terminating end portion 30 to pass through narrow slot 41.

By employing this construction, end cap 27 of cable member 22 is easily inserted into T-shaped holding zone 38 and advanced along the length of holding zone 38 whenever shackle 36 is in its raised, unlocked position. Since enlarged channel 40 is constructed for receiving terminating end portion 30, terminating end portion 30 is able to enter enlarged channel 40 and advance along the length thereof. Simultaneously therewith, rod portion 29 enters narrow slot 41 and advances along the length of slot 41. In addition, since the length of T-shaped holding zone 38 is sufficient to receive and lockingly engage two endcaps 27, an alternate embodiment of cable member 22 with endcaps 27 mounted at both ends thereof is easily accommodated.

When shackle 36 of combination lock 21 is in its unlocked position, terminating end 44 of shackle 36 is positioned above T-shaped holding zone 38. As a result, endcap 27 of cable member 22 is able to enter holding zone 38 and freely slide along the length thereof up to abutment wall 39. Whenever secure, locked interengagement of cable member 22 with housing 35 of combination lock 21 is desired, shackle 36 is moved from its open position to its closed position. This movement causes shackle 36 to move downwardly, with end 44 entering enlarged channel 40 of holding zone 38. As result of this movement, endcap 27 of cable member 22 is captured between shackle 36 and abutment wall 39. As result, endcap 27 is incapable of being withdrawn from holding zone 38 and the desired, secure, locked engagement of cable member 22 with combination lock 21 is attained.

Whenever the user desires to remove endcap 27 from secure engagement with combination lock 21, dials 37 are rotated to display the pre-set combination, thereby enabling shackle 36 to be axially movable relative to housing 35 from the closed position to the open position. Since this axial movement causes terminating end 44 of shackle 36 to be removed from blocking engagement in enlarged channel 40, endcap 27 of cable member 22 is free to slide the entire length of holding zone 38, enabling cable member 22 to be released.

The final principal component forming computer locking system 20 is dual plate securement member 23. The detailed construction and operation of dual plate securement member 23 is provided below. However, FIGS. 1 and 2 depict securement member 23 in its fully engaged and locked position within computer 24.

As depicted, securement member 23 is lockingly engaged with slot 31 formed in computer 24. By constructing securement member 23 from tamper resistant materials, such as hardened steel, breakage of securement member 23 is prevented.

By employing integrated computer locking system 20 of the present invention, any desired computer, or other valuable product is able to be securely affixed in a desired position or location. In FIGS. 1 and 2, two alternate securement arrangements are depicted. However, numerous alternate arrangements can be employed with equal efficacy.

In FIG. 1, computer 25 is lockingly engaged with dual plate securement member 23 which is retained by cable member 22. Cable member 22 is secured at one end to an existing pipe or conduit 32 which forms part of the building or structure in which computer 25 is placed. Of course, any other structural member can be employed instead of pipe/conduit 32.

As depicted, cable 22 is secured to pipe/conduit 32 by wrapping cable member 22 peripherally around pipe/conduit 32 and then passing the free end or end cap bearing end of cable 22 through loop defining plate 25 of cable 22. In this way, the loop bearing end of cable 22 is securely affixed to pipe/conduit 32.

The opposed, end cap 27 bearing end of cable 22 is then secured to combination lock 21 in holding zone 38, as detailed above. Once combination shackle 36 is lockingly secured to housing 35 with end cap 27 engaged in holding zone 38, computer 24 is securely locked and retained in the desired location. In order to further enhance the desired securement of computer 24, shackle 36 can be engaged in any available anchoring member which exists in the desired area. In this way, added security is provided.

In the alternate arrangement shown in FIG. 2, an intermediate portion of cable member 22 is wrapped about pipe/conduit 32, or other structural member, while both ends of cable member 22 are lockingly engaged with combination lock 21. As with the previous arrangement, dual plate securing member 23 is lockingly engaged in computer 24 and secured along the length of cable member 22.

As depicted, end cap 27 is mounted in holding zone 38 of housing 35 of combination lock 21 and securely affixed therein when shackle 36 is locked in housing 35. In addition, in this arrangement, loop-defining plate 25 is secured by shackle 36, thereby lockingly securing the opposed end of cable member 22 to combination lock 21.

In this arrangement, dual plate securement member 23 is lockingly engaged with computer 24, while both ends of cable member 22 are affixed to combination lock 21. As a result, any desired computer or other product is quickly and easily lockingly mounted in any desired location.

The principal unique component of fully integrated computer locking system 20 is dual plate computer securement member 23. As fully detailed below, securement member 23 comprises a construction which enables member 23 to be movable between two alternate positions. One position enables the entry and engagement of securement member 23 in slot 31 of computer 24, while the second position lockingly affixes securement member 23 in the engaged position, preventing its unwanted or unauthorized removal therefrom.

By referring to FIGS. 1–8, along with the following detailed disclosure, the construction and operation of dual plate computer securement member 23 can best be understood. As shown, securement member 23 comprises movable plate 50 which is slidingly retained within holding plate 51.

In addition, movable plate 50 incorporates aperture 52, while holding plate 51 incorporates aperture 53. In this preferred construction, apertures 52 and 53 are co-axially aligned when plates 50 and 51 are in the computer locking position, thereby enabling cable member 22 to extend therethrough. In this position, cable member 22 blocks the movement of plate 50 relative to plate 51, thereby preventing unwanted or unauthorized disengagement of securement member 23 from computer 24.

In order to attain the desired results, movable plate 50 preferably comprises a generally flat construction defined by body portion 56, intermediate portion 57, and distal end portion 58. In addition, body portion 56 comprises terminating end 60 and side edges 61 and 62. Intermediate portion 57 comprises side edges 63 and 64, while distal end portion 58 comprises side edges 65 and 66, and terminating end 67.

Figure 5:
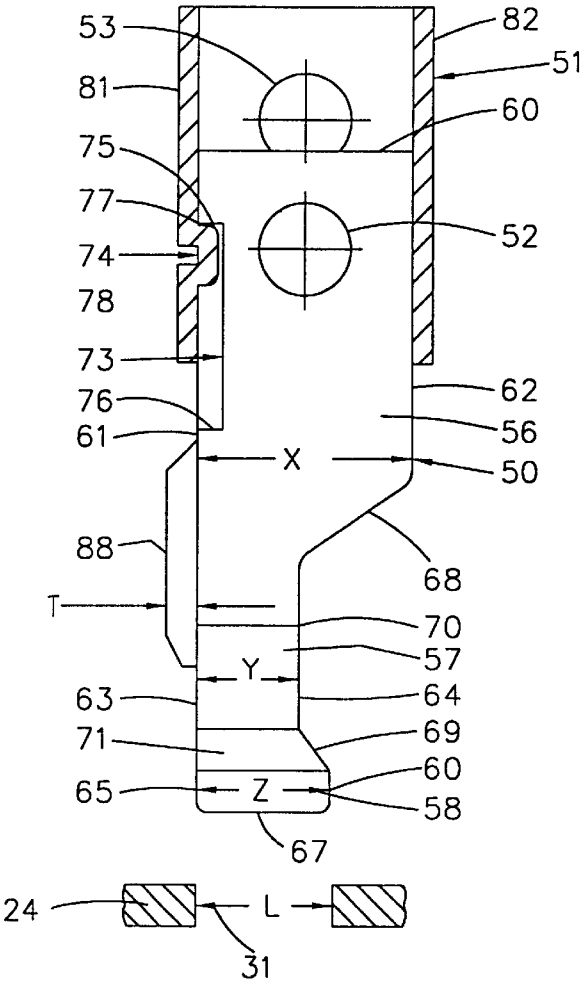
FIG. 5 is a top plan view, partially in cross-section, depicting the dual plate computer securing member in its fully extended position prior to engagement in the slot of a computer.

As shown in FIG. 5, body portion 56 comprises an overall width which is depicted as dimension "X", while intermediate portion 57 comprises a width which is depicted as dimension "Y" and distal end portion 58 comprises a width which is depicted as dimension "Z". Furthermore, as further detailed below, dimension "X" is greater than dimension "Z", while dimension "Z" is greater than dimension "Y".

In the preferred embodiment, side edges 61, 63, and 65 are generally aligned with each other, forming a continuous substantially straight, co-planar edge. As a result, body portion 56 incorporates sloped edges 68 which provides the transition from side edges 62 of body portion 56 to side edges 64 of intermediate portion 57, since intermediate portion 57 is substantially narrower than body portion 56. In addition, sloped edge 69 extends from side edge 64 of intermediate portion 57 to side edge 66 of distal end portion 58, providing the requisite transition from narrow intermediate portion 57 to wider distal end portion 58.

In the preferred construction, body portion 56 incorporates notch or recess zone 73 formed in side edge 61, positioned for cooperating engagement with detent or wall 74 of holding plate 51. As detailed below, this construction controls the movement of plate 50 relative to plate 51.

Figure 6:
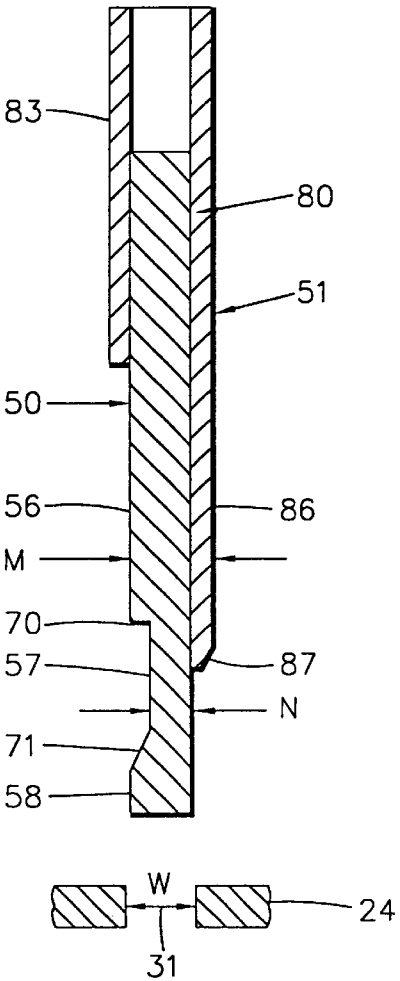
FIG. 6 is a cross-sectional, side elevation view of the dual plate. computer securing member of FIG. 5.

Furthermore, intermediate section 57 preferably incorporates ledge or wall 70 formed substantially mid-way along the length thereof, and extending substantially perpendicularly from side edge 63 to side edge 64. As a result, intermediate section 57 comprises two separate and distinct thicknesses formed along the length thereof, as shown in FIG. 6. As depicted, intermediate section 57 comprises thickness "M" formed in the portion thereof interconnected with body portion 56, while intermediate section 57 also comprises thickness "N", formed in the portion thereof which is interconnected with distal end portion 58.

Finally, the preferred construction of movable plate 50 is completed by forming distal end portion 58 with a thickness substantially equivalent to thickness "M". In addition, distal end portion 58 incorporates sloped surface 71 which extends from the top surface of intermediate section 57 to the top surface of distal end of portion 58, providing the transition from thickness "M" of distal end portion 58 to thickness "N" of intermediate portion 57.

In the preferred embodiment of the present invention, holding plate 51 is constructed to partially envelope movable plate 50 in a manner which allows plate 50 to be controllably movable in one planar direction, while being captured and incapable of being separated or removed from plate 51. In this regard, holding plate 51 comprises flat rear panel 80, side wall 81 and 82, and top flanges.

As depicted, side walls 81 and 82 extend substantially perpendicularly from rear panel 80 while top flanges 83 extends substantially perpendicularly from side wall 81, with top flange 84 extending substantially perpendicularly from side wall 82. In this way, holding plate 1 peripherally surrounds and embraces movable plate 50, enabling sliding, planar movement while preventing dislocation or dislodgement of plate 50 from plate 51.

Figure 8:
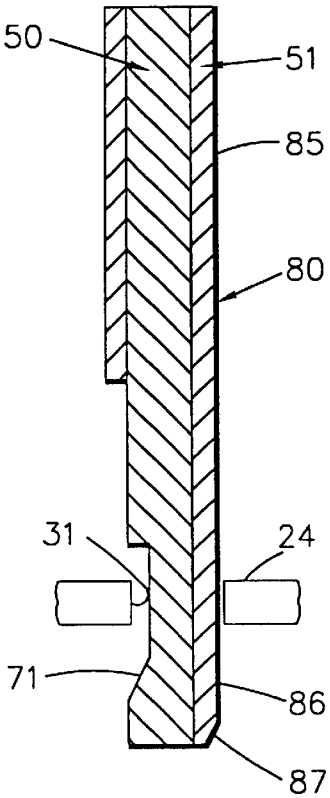
FIG. 8 is a cross-sectional, side elevation view of the dual plate securing member of FIG. 7.
Figure 7:
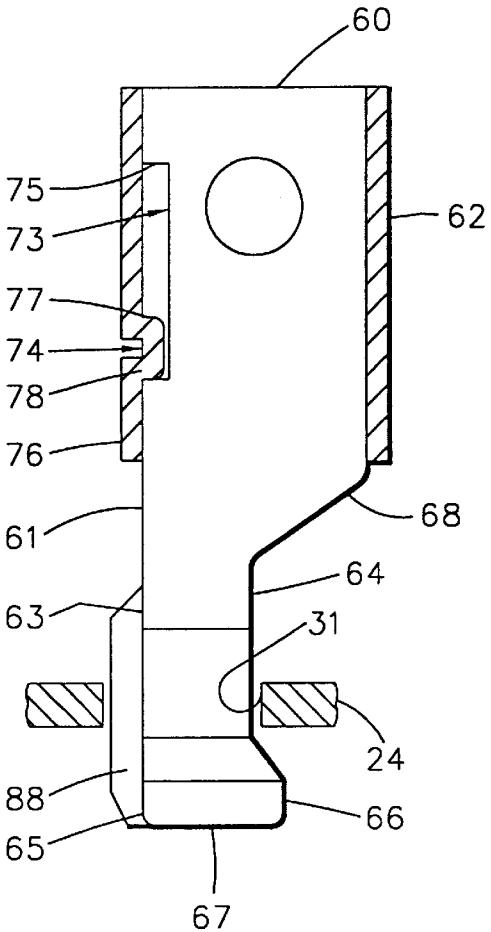
FIG. 7 is a top plan view, partially in cross-section, depicting the dual plate computer securing member in its closed and engaged position securely mounted in the slot of a computer.

In this regard, as mentioned above, plate 50 is movable between a first extended position, as depicted in FIGS. 5 and 6, and a second retracted position, as depicted in FIGS. 7 and 8. In controlling and limiting the movement of plate 50 within plate 51, notch/recessed zone 73 comprises abutment stops 75 and 76 forming a part hereof, with detent 74 comprising walls 77 and 78.

As shown in FIG. 5, the movement of plate 50 into the first, fully extended position is controlled and limited by contact between abutment stop 75 with wall 77. Similarly, the movement of plate 50 into its second, fully retracted position is controlled and limited by contact between abutment stop 76 with wall 78. In this way, each of the two desired, alternate positions of plate 50 relative to plate 51 are easily attained and precisely controlled.

Rear panel 80 of holding plate 51 incorporates main portion 85 and extension portion 86 which is integrally formed with and extends from main portion 85 and in cooperating alignment with intermediate portion 57 and distal end portion 58 of plate 50. As a result, extension portion 86 comprises an overall width substantially equivalent to dimension "Y".

Finally, extension portion 86 comprises a generally J-shape which extends substantially its entire length. This J-shape is defined by back wall 87 and side wall 88. As further detailed below, back wall 87 and side wall 88 are constructed for cooperating with distal end portion 58 and intermediate portion 57. In this regard, side wall 88 is aligned with and extends directly adjacent with edge 63 of intermediate portion 57 and edge 65 of distal end portion 58.

By employing the construction detailed above, dual plate computer securement member 23 is able to be quickly and easily inserted into any desired computer, or other product, and locked in secure holding engagement therewith. In this regard, dual plate securement member 23 is constructed with its dimension being controlled for locked interengagement with the standard dimension of slot 31 or computer 24. As a result, dimension "Z" of distal end portion 58 is constructed to be slightly less than length "L" of slot 21. Furthermore, dimension "M" is constructed to be slightly less than width "W" of slot 31. In this way, distal end portion 58 is able to freely pass through slot 31 whenever movable plate 50 is in its extended position, as shown in FIGS. 5 and 6.

In operation, dual plate computer securing member 23 is removed from table 22 after end cap 27 has been removed from engagement with combination lock 21. Then, movable plate 50 is longitudinally advanced relative to holding plate 51 in order to place plate 50 in its extended position.

Then, distal end portion 58 of movable plate 50 is advanced through slot 31 of computer 24. Once intermediate portion 57 is positioned substantially within slot 31, holding plate 51 is advanced into slot 31 until plate 50 is in its fully retracted position, surrounded by holding plate 51. When in this position, apertures 52 and 53 are aligned, enabling cable member 22 to be threaded therethrough, preventing plate 50 from moving relative to plate 51.

Once dual plate securement member 23 is mounted in slot 31 of computer 24, with cable member 22 extending through apertures 52 and 53, securement member 23 is lockingly engaged with computer 24, incapable of being removed therefrom without authorization or approval. By referring to FIGS. 7 and 8, this secure, locked engagement can best be understood.

As depicted, when dual plate securement member 23 is in its retracted position, with plates 50 and 51 aligned with each other, side wall 88 of extension portion 86 of holding plate 51 extends along side edges 63 of intermediate portion 57 and side edge 65 of distal end portion of plate 50. The presence of side wall 88 in this position effectively increases dimensions "Y" and "Z" by the thickness "T" of sidewall 88.

By constructing dual plate securement member 23 with dimension "Y" of intermediate portion 57 and thickness "T" of sidewall 88 being slightly greater, in combination, to length "L" of slot 31, intermediate portion 57 is able to be retained within slot 31 with limited longitudinal movement. However, distal end portion 58 is incapable of being removed from slot 31, since dimension "Z" of distal end 58 in combination with thickness "T" of sidewall 88 is substantially greater than length "L" of slot 31. As a result, edge 69 of distal end 58 contacts slot 31, preventing distal end 58 from being removed from slot 31.

In addition, rear panel 80 comprises thickness "P" throughout main portion 85 and extension portion 86. In addition, thickness "N" of intermediate portion 57 when combined with thickness "P" of extension portion 86 is constructed to be slightly less than width "W" of slot 31. As a result, when securement member 23 is in its fully engaged position, intermediate portion 58 in combination with extension portion 86 is able to be retained in slot 31 and able to achieve limited longitudinal movement therein. However, axial removal of securement member 23 is prevented.

In this dimension and position, thickness "M" of distal end portion 58 is combined with thickness "P" of extension portion 86. Since thickness "M" is constructed to be slightly less than width "W" of slot 31, the combined dimension of thickness "M" and "P" substantially exceeds width "W" of slot 31. Consequently, removal of securement member 23 is not possible and any attempt to withdraw member 23 from slot 31 merely causes sloping surface 71 to contact slot 31, preventing any further movement thereof.

As is evident from the foregoing detailed discussion, fully integrated computer locking system 20 provides the secure locked engagement of any desired computer, or other product, in a desired location. In order to achieve the desired securement, dual plate, computer securement member 23 is removed from cable member 22 and placed in its computer engaging position with plate member 50 extending from plate member 51. Then, plate member 50 is inserted into slot 31 of computer 24, followed by the movement of plate member 51 into slot 31 and cooperating alignment with plate 50.

Once plates 50 and 51 are in their second, aligned position, securement member 23 is in locked engagement in slot 31 of computer 24. Then, cable member 22 is affixed to an existing structural member and passed through apertures 53 and 54, preventing movement of plate 50 relative to plate 51. Finally, the free end, or ends, of cable member 22 is lockingly engaged with combination lock 21 and combination lock 21 is locked. Once this process is completed, the computer, or other product, is securely locked and engaged in a precisely desired location, free from unauthorized removal. It will thus be seen that the objects set forth above, among those made apparent from the preceding description, are efficiently obtained and, since certain changes may be made in the above article without departing from the scope of this invention, it is intended that all matter contained in this disclosure or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention what I claim as new and desire to secure by Letters Patent is:

1. A locking and securing system for affixing a desired, slot-bearing product in a specific location, said system comprising:

A. a combination lock assembly incorporating a lockable shackle and a receiving zone constructed for securing at least one endcap therein;

B. an elongated cable member constructed for being wrapped about a structural support member and comprising at least one endcap affixed to a terminating end thereof and constructed for locked engagement in said combination lock; and C. a securement member constructed for being lockingly engageable within a slot formed in a desired product, said member comprising a. a movable plate member, positionable between a first extended position and a second fully engaged position, and comprising a substantially flat body portion, a narrow intermediate portion extending from the body portion, and a distal end portion dimensioned to be wider than the intermediate portion and smaller than the body portion;

b. a holding plate member constructed for partially peripherally surrounding the movable plate, limiting the movement of the movable plate, and incorporating an extension portion integrally formed therewith for cooperating with the distal end portion and intermediate portion of the movable plate to increase the overall width and thickness of the distal end portion and intermediate portion thereof when the movable plate is in its second engaged position, and c. said movable plate member and said holding plate member being cooperatively associated to provide longitudinal insertion thereof into the slot formed in the desired product when the movable plate is in its first extended position, and secure locked engagement thereof in the slot when the movable plate and the holding plate are longitudinally moved into the second fully engaged position, wherein the extension portion of the holding plate increases the overall width and thickness of the distal end of the movable plate, thereby preventing the longitudinal removal of the securement member from the slot of the desired product;

whereby a fully integrated product locking and securing system is attained which is easily affixed to a desired slot-bearing product and lockingly mounted in any location in a simple, longitudinal movement, free from any arcuate rotation.

2. The locking and securing system defined in claim 1, wherein the movable plate member and the holding plate member forming the securement member are each further defined as comprising apertures formed adjacent one end thereof, with said apertures being positioned for coaxial alignment when the plate members are in the second, fully engaged position, with said apertures being dimensioned for cooperative association with the cable member for restricting movement of the plate members when the cable member extends therethrough.

3. The locking and securing system defined in claim 2, wherein said cable member is further defined as comprising material resistant to being broken or severed.

4. The locking and securing system defined in claim 3, wherein said cable member is further defined as being formed from braided or woven wire fibers.

5. The locking and securing system defined in claim 3, wherein the receiving zone formed in the combination lock assembly is further defined as comprising a T-shaped elongated slot formed along the bottom surface thereof in cooperating relationship with a portion of the shackle, for enabling the shackle to move into and out of locking engagement of said receiving zone in response to the movement of the shackle between a first locked position and a second unlocked position.

6. The locking and securing system defined in claim 5, wherein said T-shaped elongated slot is further defined as being dimensioned for receiving and holding the endcap affixed to the at least one terminating end of the cable member and for securely maintaining the endcap therein whenever the shackle is in its lock position.

7. The locking securing system defined in claim 6, wherein the endcap of the cable member is further defined as being slidingly engageable and lockingly retained in the T-shaped elongated slot in response to movement of the shackle between its two alternate positions.

8. The locking and securing system defined in claim 7, wherein said endcap is further defined as comprising and enlarged terminating end constructed for mating, sliding engagement in an enlarged section of the T-shaped elongated slot and a smaller diameter connecting zone dimensioned for sliding interengagement in a smaller width channel of the T-shaped elongated slot.

9. The locking and securing system defined in claim 2, wherein the slot of the slot-bearing product is further defined as having a length equivalent to "L" and a width equivalent to "W".

10. The locking and securing system defined in claim 9, wherein said product comprises a computer.

11. The locking and securing system defined in claim 9, wherein the distal end portion of the movable plate member is further defined as comprising:

1. an overall width which is slightly less than dimension "L", and
2. an overall thickness which is slightly less than dimensioned "W".

12. The locking and securing system defined in claim 11, wherein the intermediate portion of the movable plate member is further defined as comprising:

1. an overall width which is less than the width of the distal end portion, and
2. an overall thickness which is less than the thickness of the distal end portion.

13. The locking and securing system defined in claim 12, wherein the movable plate member is further defined as being constructed with the said substantially flat body portion, intermediate portion, and distal end portion all been aligned along one side edge.

14. The locking and securing system defined in claim 13, wherein the intermediate portion of the movable plate member is further defined as comprising a ledge or wall portion formed therein for assuring a reduced thickness zone.

15. A locking and securing system for affixing a desired, slot-bearing product in a specific location, said system comprising:

A. a combination lock assembly incorporating a lockable shackle and a receiving zone constructed for securing at least one endcap therein;

B. an elongated cable member constructed for being wrapped about a structural support member and comprising at least one endcap affixed to a terminating end thereof and constructed for locked engagement in said combination lock; and C. a securement member constructed for being lockingly engageable within a slot formed in a desired product, said member comprising a. a movable plate member, positionable between a first extended position and a second fully engaged position, and comprising 1. a substantially flat body portion, a narrow intermediate portion extending from the body portion and a distal end portion dimensioned to be wide and have a greater thickness than the intermediate portion and having a width which is less than the body portion, and
2. a ramped side edge and a sloping top surface, both extending between the intermediate portion and the distal end portion for providing the transition between the enlarged thickness and greater width of the distal end portion relative to the intermediate portion, and b. a holding plate member constructed for peripherally surrounding the movable plate limiting the movement of the movable plate, and cooperating with the movable plate to increase the overall width and thickness of the distal end portion and intermediate portion thereof when the movable plate is in its second engaged position, whereby a fully integrated product locking and securing system is attained which is easily affixed to a desired slot-bearing product and lockingly mounted in any location.

16. The locking and securing system defined in claim 15, wherein said holding plate member is further defined as comprising a J-shaped end portion formed therewith and positioned for cooperating relationship with the distal end portion and intermediate portion of the movable plate member, when the movable plate member is in its second, fully engaged position, for effectively increasing the overall thickness and width of the intermediate portion and distal end portion, thereby assuring secure engagement of said components when mounted in the slot of the product.

17. A locking and securing system for affixing a desired, slot-bearing product in a specific location, said system comprising:

A. a combination lock assembly incorporating a lockable shackle and a receiving zone constructed for securing at least one endcap therein;

B. an elongated cable member constructed for being wrapped about a structural support member and comprising at least one endcap affixed to a terminating end thereof and constructed for locked engagement in said combination lock;

C. a securement member constructed for being lockingly engageable within a slot formed in a desired product, said member comprising a. a movable plate member, positionable between a first extended position and a second fully engaged position, and comprising a substantially flat body portion, a narrow intermediate portion extending from the body portion, a distal end portion dimensioned to be wider than the intermediate portion and smaller than the body portion, and a notch formed therein, said notch having abutment stops defining the opposed ends thereof, b. a holding plate member constructed for peripherally surrounding the movable plate limiting the movement of the movable plate, and cooperating with the movable plate to increase the overall width and thickness of the distal end portion and intermediate portion thereof when the movable plate is in its second engaged position, and comprising a detent or wall portion formed therein for cooperating with the notch of the movable plate for controlling the longitudinal movement of the movable plate relative to the holding plate, enabling the movable plate to move between the opposed abutment stops thereof, and c. the movable plate member and the holding plate member being further defined as comprising apertures formed adjacent one end thereof, with said apertures being positioned for coaxial alignment when the plate members are in the second, fully engaged position, with said apertures being dimensioned for cooperative association with the cable member for restricting movement of the plate members when the cable member extends therethrough;

whereby a fully integrated product locking and securing system is attained which is easily affixed to a desired slot-bearing product and lockingly mounted in any location.

18. The locking and securing system defined in claim 17, wherein the space distance between the abutment stops of the notch formed in the movable plate defines the first extended position of the movable plate member and the second fully engaged position of the movable plate member.

* * * * *